US007922557B2

(12) United States Patent
Fearon et al.

(10) Patent No.: US 7,922,557 B2
(45) Date of Patent: Apr. 12, 2011

(54) HANDHELD TOY FOR EMITTING FIGHTING NOISES AND METHOD THEREFOR

(76) Inventors: John S. Fearon, Phoenix, AZ (US); Paul R. Mark, Los Angeles, CA (US)

( * ) Notice: Subject to any disclaimer, the term of this patent is extended or adjusted under 35 U.S.C. 154(b) by 819 days.

(21) Appl. No.: 10/879,983

(22) Filed: Jun. 29, 2004

(65) Prior Publication Data

US 2005/0287904 A1 Dec. 29, 2005

(51) Int. Cl.
*A63H 5/00* (2006.01)

(52) U.S. Cl. ..... 446/397; 446/404

(58) Field of Classification Search ..... 446/408, 446/404, 397

See application file for complete search history.

(56) References Cited

U.S. PATENT DOCUMENTS

| | | | | |
|---|---|---|---|---|
| 4,299,386 | A | 11/1981 | Kulesza et al. | |
| 4,457,097 | A | 7/1984 | Miller et al. | |
| 4,553,946 | A | 11/1985 | Miller | |
| 5,059,150 | A | 10/1991 | Kuo | |
| 5,135,423 | A | 8/1992 | Chung | |
| 5,259,807 | A | 11/1993 | Crow | |
| 5,314,371 | A | 5/1994 | Mason | |
| 5,533,949 | A | 7/1996 | Hwang | |
| 5,648,753 | A | 7/1997 | Martin | |
| 5,674,076 | A | 10/1997 | Billings et al. | |
| 5,722,195 | A * | 3/1998 | Bentley et al. | 42/74 |
| 5,816,885 | A | 10/1998 | Goldman et al. | |
| 6,046,670 | A | 4/2000 | Martin | |
| 6,213,055 | B1 | 4/2001 | Willinger et al. | |
| 6,236,305 | B1 | 5/2001 | Martin | |
| 6,267,639 | B1 * | 7/2001 | Menow et al. | 446/81 |
| 6,296,543 | B1 | 10/2001 | Andrews | |
| 6,409,636 | B1 * | 6/2002 | Risso et al. | 482/82 |
| D464,053 | S * | 10/2002 | Zicolello | D14/409 |
| 6,484,942 | B1 * | 11/2002 | Yokoyama et al. | 463/8 |

(Continued)

FOREIGN PATENT DOCUMENTS

GB 2293984 A * 4/1996

(Continued)

OTHER PUBLICATIONS

The Gale Group, HFD—The Weekly Home Furnishings Newspaper, "Conair emphasizes innovation; to introduce palm-size phone", Jan. 1, 1990, p. 116.*

*Primary Examiner* — Gene Kim
*Assistant Examiner* — Urszula M Cegielnik
(74) *Attorney, Agent, or Firm* — Jeffrey Weiss; Jeffrey D. Moy; Weiss & Moy, P.C.

(57) ABSTRACT

A handheld toy for simulating a fight sequence has an audio circuit for recording and playing simulated fighting sounds. A body section is provided. The body section has a hollow interior section for housing the audio circuit. The body section has a first side which is rounded to allow the first side to fit comfortably in a palm of a user. A second side of the body section has a plurality of ridges. The ridges form finger grips to allow a hand of the user to hold the handheld toy. The body section has a movable cover to replace components of the audio circuit. A plurality of buttons is coupled to the audio circuit. Each of the plurality of buttons activates a different simulated fighting sound of the audio circuit. The user presses different buttons while performing a simulated fight sequence.

18 Claims, 2 Drawing Sheets

U.S. PATENT DOCUMENTS

| | | | | |
|---|---|---|---|---|
| 6,538,565 | B1 * | 3/2003 | Gotfried | 340/384.3 |
| D476,356 | S * | 6/2003 | Martinez | D17/1 |
| D478,330 | S * | 8/2003 | Yang | D14/417 |
| 7,038,575 | B1 * | 5/2006 | Frohman et al. | 340/384.7 |
| 2002/0044120 | A1 | 4/2002 | Watanabe et al. | |
| 2002/0044129 | A1 * | 4/2002 | Leiper | 345/156 |
| 2002/0151337 | A1 * | 10/2002 | Yamashita et al. | 463/8 |

FOREIGN PATENT DOCUMENTS

| | | | |
|---|---|---|---|
| WO | WO 0207843 | A1 * | 1/2002 |

* cited by examiner

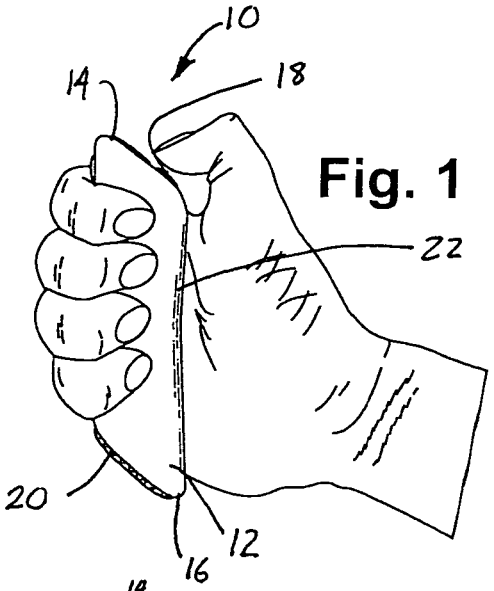
Fig. 1
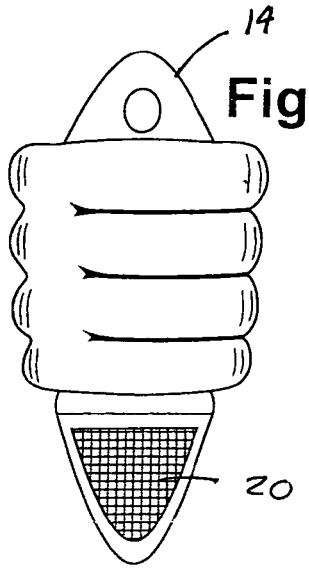
Fig. 1A
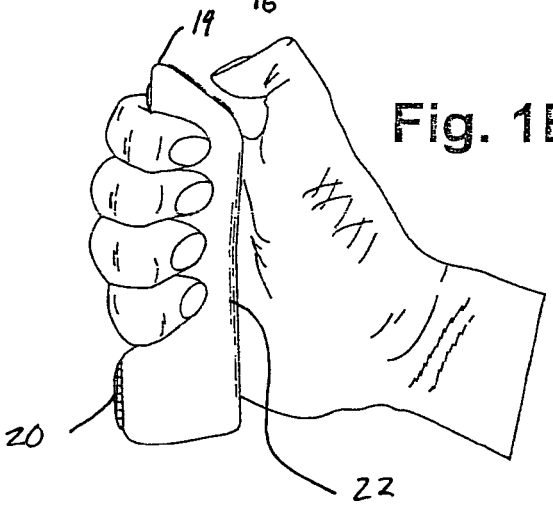
Fig. 1B
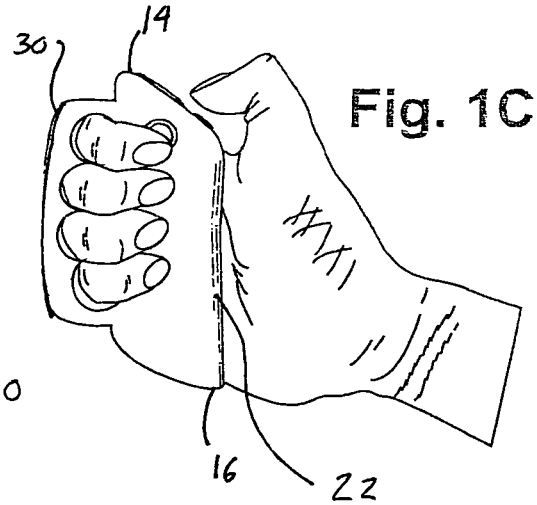
Fig. 1C
Fig. 1D
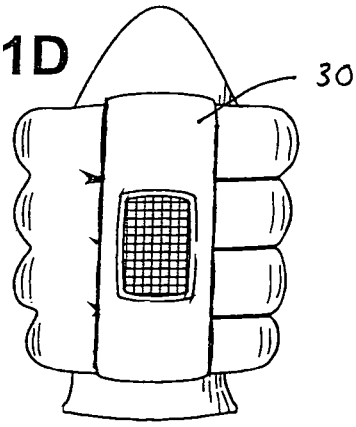

HANDHELD TOY FOR EMITTING FIGHTING NOISES AND METHOD THEREFOR

BACKGROUND OF THE INVENTION

1. Field of the Invention

This invention relates generally to handheld toys, and more specifically, to a hand held toy which has pre-recorded fighting sounds, and which will allow one to record new fighting sounds, the toy being used in simulated fight sequences.

2. Description of the Prior Art

Toys which produce sounds of all types are well known. For example, toy guns are made which can simulate machine gun fire. Toy pianos have been made which simulate piano music. Many of these toys store multiple types of sounds. Different sounds may be selected by selecting/pressing different predetermined button.

Most toys only have a set number of prerecorded sounds. These toys do not have the ability to add new sounds. Thus, if a person does not like the sounds stored on the toy, there is no way to change the prerecorded sounds to add some new ones.

Another problem with current toys are that many of the toys which have prerecorded sounds are rather large in size. Many of these toys cannot be held and hidden in the palm of one's hand. Thus, one cannot come up and surprise/startle someone with the prerecorded sounds. Furthermore, with large bulky toys, one cannot simulate realistic fight sequences since the toy is visible to those around them. By having a small handheld toy, one can stage a realistic fight sequence with realistic fighting sounds since the toy is hidden and cannot be seen.

Therefore, a need existed to provide an improved toy. The improved toy will overcome the problems associated with prior art toys. The improved toy will be handheld and compact in size. The handheld toy will have the ability to record and store new sounds.

SUMMARY OF THE INVENTION

In accordance with one embodiment of the present invention, it is an object of the present invention to provide an improved toy.

It is another object of the present invention to provide an improved toy that overcomes the problems associated with prior art toys.

It is still another object of the present invention to provide an improved toy which is handheld and compact in nature.

It is still another object of the present invention to provide an improved toy that has the ability to record and store new sounds.

BRIEF DESCRIPTION OF THE EMBODIMENTS

In accordance with one embodiment of the present invention, a handheld toy for simulating a fight sequence is disclosed. The handheld toy has an audio circuit for recording and playing simulated fighting sounds. A body section is provided. The body section has a hollow interior section for housing the audio circuit. The body section has a first side which is rounded to allow the first side to fit comfortably in a palm of a user. A second side of the body section has a plurality of ridges. The ridges form finger grips to allow a hand of the user to hold the handheld toy. The body section has a movable cover to replace components of the audio circuit. A plurality of buttons are coupled to the audio circuit. Each of the plurality of buttons activates a different simulated fighting sound of the audio circuit. The user presses different buttons while performing a simulated fight sequence.

In accordance with one embodiment of the present invention, a method of simulating a realistic choreograph fighting sequence comprising: providing a handheld toy having a plurality of buttons, and a plurality of prerecorded simulated fighting sounds, pressing different buttons plays a different prerecorded simulated fighting sound; choreographing a fight sequence; and pressing a first button of the plurality of buttons to play a first prerecorded simulated fighting sound when a user performs a first fighting move.

The foregoing and other objects, features, and advantages of the invention will be apparent from the following, more particular, description of the preferred embodiments of the invention, as illustrated in the accompanying drawing.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiments when read in conjunction with the accompanying drawings.

FIG. 1 is a side view of one embodiment of the present invention in the palm of a user.

FIG. 1A is a front view of another embodiment of the present invention in the palm of a user.

FIG. 1B is a side view of the embodiment depicted in FIG. 1A in the palm of a user.

FIG. 1C is a side view of another embodiment of the present invention in the palm of a user.

FIG. 1D is a front view of another embodiment of the present invention.

DETAILED DESCRIPTION OF THE PREFERRED EMBODIMENT

Figure 2:
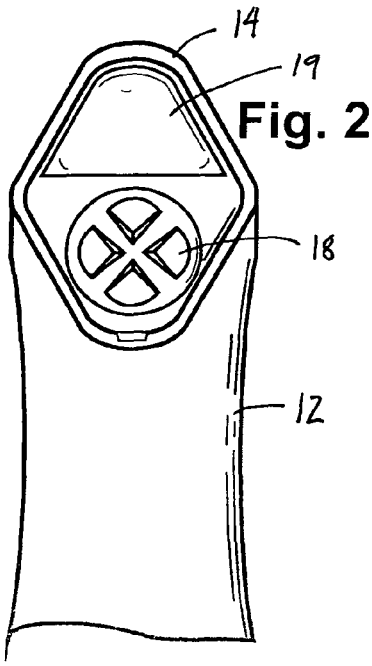
FIG. 2 is a top view of the embodiment depicted in FIG. 1.

Referring to FIG. 1, one embodiment of the handheld toy for emitting fighting noises 10 (hereinafter handheld toy 10) is shown. The handheld toy 10 has a body section 12. The body section 12 is generally made out of a lightweight but sturdy material such as a hard plastic or the like. However, other materials may be used without departing from the spirit and scope of the present invention.

The body section 12 is shaped as a elongated tube having a hollow interior. The top 14 and bottom 16 surfaces of the body section 12 is generally oblong in shape. The top surface 14 is angled so that the surface is slanted towards the user. An angled top surface 14 will allow a user of the handheld toy 10 to more easily press the buttons 18 located on the top surface 14.

In the embodiment depicted in FIG. 1, the bottom surface 16 is angled away from the user. A speaker 20 is coupled to the bottom surface 16. By angling the bottom surface 16 away from the user, the speaker 20 will be directed away from the body of the user and to an open area. This will better distribute the sound emanating from the speaker 20.

A first side 22 of the body section 12 is slightly rounded to form an arc. The arc in the first side 22 will allow the body section 12 to conform to the palm of the user. Thus, the arc will allows the body section to fit more comfortably in the palm of the user. A second side 24 of the body section 12 has a plurality of ridges 26 (see FIG. 3). The ridges 26 form finger grooves in the body section 12. When the body section 12 is placed in the palm of the user, the user may wrap his/her fingers around the ridges 26 to obtain a better grip on the handheld toy 10.

As stated above, the top surface 14 has a plurality of buttons 18. Each button 18 when pressed will send a different simulated fight sound effect out through the speaker 20. A record button 19 is also located on the top surface 14. By pressing the record button 19, one may record and store different sounds in the handheld toy 10. These recorded sounds can be replayed by pressing the appropriate button 18. In order to record and store a new sound, one must press the record button 19 and the desired button 18. When one is finished recording the new sound, the user will release the record button 19 and the appropriate button 18. To play the newly recorded sound, the user just needs to press the appropriate button 18.

Referring to FIGS. 1A-1B, a second embodiment of the handheld toy 10 is shown. The handheld toy 10 in FIGS. 1A-1B is similar to that shown in FIG. 1. Thus only the differences will be described. The main difference between the two embodiments is that the body section 12 is "L" shaped. The "L" shaped body section 12 allows the speaker 20 to be coupled to the front end of the leg of the "L" shaped body section 12. This allows the sounds emanating from the speaker 20 to be directed directly in front of the hand holding the handheld toy 10.

Referring to FIGS. 1C-1D, a third embodiment of the handheld toy 10 is shown. The handheld toy 10 in FIGS. 1C-1D is similar to that shown in previous embodiments. Thus only the differences will be described. The body section 12 is similar to that disclosed in FIG. 1. The main difference is that the ridges 26 formed on the second side 24 have a cover 30. The cover 30 is an ergonomically shaped cover 30 that would provide an appropriate comfort level for the user. The speaker 20 in this embodiment is coupled to the outer surface of the cover 30. This allows the sounds emanating from the speaker 20 to be directed directly in front of the hand holding the handheld toy 10.

Figure 4:
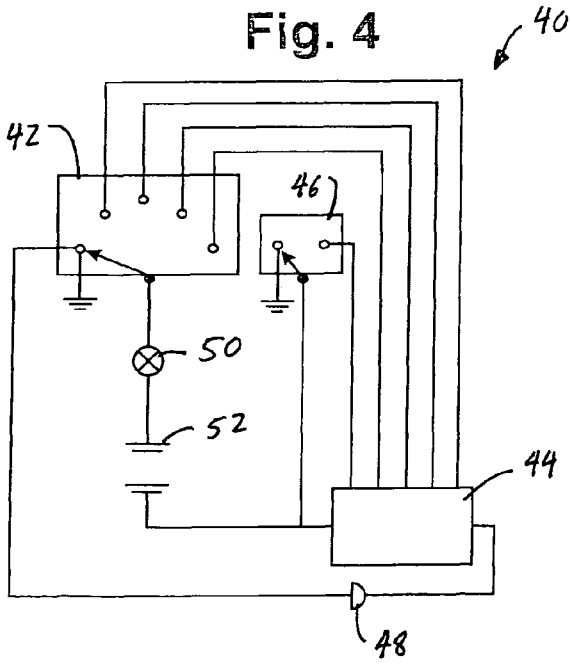
FIG. 4 is a simplified electrical schematic showing the internal circuitry used in the present invention.

Referring now to FIG. 4, a simplified electrical schematic is shown of the circuitry 40 used in the handheld toy 10. The circuitry 40 has a first switching mechanism 42. The switching mechanism 42 corresponds to the buttons 18. The switching mechanism 42 is coupled to a sound chip 44. The sound chip 44 is able to record and play back the recorded sounds. A second switching mechanism 46 is also coupled to the sound chip 44. The second switching mechanism 46 is used to record new fighting sound effects (or other types of sounds) into the sound chip 44. The second switching mechanism 46 corresponds to the button 19. The sound chip 44 will come with a plurality of prerecorded fighting sounds. However, one may add a new sound to the sound chip 44. In order to record a new sound, a microphone 48 is coupled to the sound chip 44. As stated above, in order to record a new sound, one must press the record button 19 of the second switching mechanism 46 and the desired button 18 of the first switching mechanism 42. The new sound is then recorded by the microphone 48 and sent to the sound chip 44. When one is finished recording the new sound, the user will release the record button 19 of the second switching mechanism 46 and the appropriate button 18 of the first switching mechanism 46. To play the newly recorded sound, the user just needs to press the appropriate button 18. The circuitry 40 has a speaker 50. The speaker 50 is used to deliver the recorded sounds. In order to power the circuitry 40, a power supply 52 is coupled to the sound chip 44. The power supply is generally a battery. However, other types of power supplies may be used without departing from the spirit and scope of the present invention.

Figure 3:
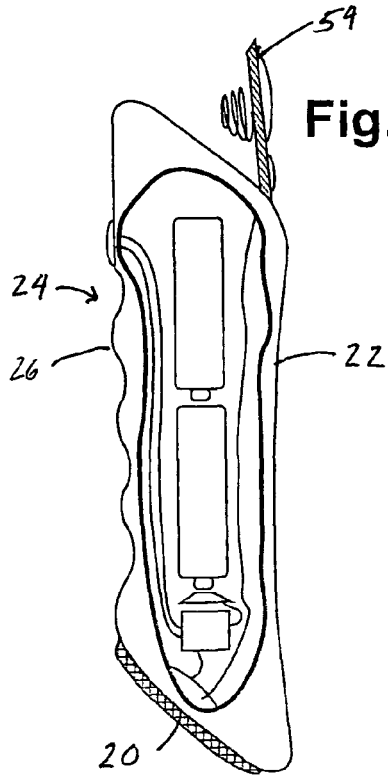
FIG. 3 is a side view of the embodiment depicted in FIG. 1 showing one way for inserting batteries into the present invention.

The circuitry 40 is positioned inside the body section 12. In order to change out the power supply 52, a covering 54 needs to be removed from the body section 12. Referring to FIG. 3, one embodiment of the covering 54 is shown. In this embodiment, the covering 54 is movably coupled to the top surface 14 of the body section 12. The covering 54 on the top surface 14 is removable so that one can insert the power supply 52 into the body section 12. Once the power supply 52 is inserted into the body section 12, the covering 54 may be closed.

Figure 3A:
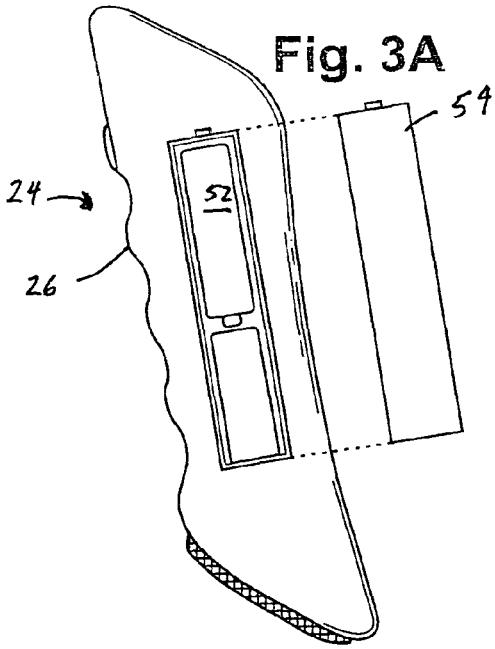
FIG. 3A is a side view of the embodiment depicted in FIG. 1 showing another way for inserting batteries into the present invention.

FIG. 3A shows another embodiment for the covering 54. In this embodiment, the covering 54 is movably coupled to a side surface of the body section 12. The covering 54 on the side surface is removable so that one can insert the power supply 52 into the body section 12. Once the power supply 52 is inserted into the body section 12, the covering 54 may be closed.

The handheld toy 10 will have a plurality of prerecorded fighting sounds. As stated above, new sounds may be recorded and played through the handheld toy 10. The handheld toy 10 is good for performing simulated fight sequences having fighting sound effects. The fighting sound effects of the handheld toy 10 are similar to what one would typically hear from a martial arts type movie, especially, but not limited to, the ones produced in the 1970's. The fighting sound effects include but are not limited to kicking, punching, chopping, slashing, slapping, and the swooshing type sound effects of mis-strikes due to these actions. The fighting sound effects may also include weapon sound effects including, but not limited to, swords, throwing stars, num-chucks, and the like, and the sound effects of these weapons mis-striking as well. Verbal type sounds may also be included. These types of sounds include, but are not limited to, yelling, screaming, and taunting phrases in any language, including fictional languages. All sound effects may be used individually or in combination with other sound effects.

Two people may have a choreograph play fight sequence. When a person throws a punch, a button 18 may be pressed which transmits a punching sound through the speaker 20. Likewise, a person who kicks another party may push another button 18 which transmits a kicking sound through the speaker 20. An entire fight sequence may be performed having realistic fighting sounds.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A method of simulating a realistic choreograph physical combat fighting sequence comprising:

providing a portable handheld toy having a plurality of buttons, and a plurality of prerecorded simulated physical combat fighting sounds, pressing different buttons plays a different prerecorded simulated physical combat fighting sound, wherein the handheld toy is held in a palm of a user, the handheld toy having a body member, a bottom section of the body member angled away from the user when the body member is held in the palm of the user, the bottom section having a speaker to distribute the different prerecorded simulated physical combat fight sounds;

choreographing a physical combat fight sequence by the user of the handheld toy; and pressing a first button of the plurality of buttons by the user to play a first prerecorded simulated physical combat fighting sound simultaneously as said user performs a first physical combat fighting move so as to create an effect that said first physical combat fighting move created said first physical combat fighting sound;

wherein the simulated physical combat fighting sounds comprises: kicking, punching, karate-type chopping, karate-type slashing, slapping, swooshing type sound effects of mis-strikes, and combinations thereof.

2. The method of claim 1 further comprising pressing a second button of the plurality of buttons by the user to play a second prerecorded simulated physical combat fighting sound simultaneously as said user performs a second different physical combat fighting move so as to create an effect that said second physical combat fighting move created said second physical combat fighting sound.

3. The method of claim 2 further comprising pressing a third button of the plurality of buttons to play a third prerecorded simulated physical combat fighting sound simultaneously as said user performs a third different physical combat fighting move so as to create an effect that said third physical combat fighting move created said third physical combat fighting sound.

4. The method of claim 2 wherein providing a portable handheld toy having a plurality of buttons and a plurality of prerecorded simulated physical combat fighting sounds further comprises:

providing an audio circuit housed in the body member of the handheld toy for recording and playing simulated physical combat fighting sounds, the plurality of buttons coupled to the audio circuit; and wherein the body member has a hollow interior section for housing the audio circuit, the body section having a first side which is rounded to allow the first side to fit comfortably in the palm of the user and a second side having a plurality of ridges, the ridges forming finger grips to allow a hand of the user to hold the handheld toy, the body member having a movable cover to replace components of the audio circuit.

5. The method of claim 4 wherein providing a body section further comprises:

providing the body having a top area angled towards the user; and coupling the buttons to the top area of the body member, the angled top area allowing the user to more easily press the button when holding the handheld toy.

6. The method of claim 4 wherein providing the audio circuit further comprises:

providing a sound recording and storage device for recording and storing the simulated physical combat fighting sounds;

providing a first switching device coupled to the sound recording and storage device and the plurality of switches for selecting one of the simulated physical combat fighting sounds;

providing a second switching device coupled to the sound recording and storage device for recording different physical combat fighting sounds on to the sound recording and storage device;

providing a speaker coupled to the first switching device and the sound recording and storage device;

providing a microphone coupled to the first switching device and the sound recording and storage device; and providing a power supply.

7. The method of claim 6 wherein the body member is AL@ shaped and the speaker is coupled to a front edge of a bottom leg section of the AL@ shaped body member.

8. The method of claim 6 wherein the body member further has a handle coupled to the second side of the body member, the handle having a plurality of ridges, each ridge of the handle corresponding to the ridges on the second side of the body member and the speaker is coupled to a front section of the handle.

9. The method of claim 1 wherein the simulated physical combat fighting sounds further comprises weapon sounds comprising: swords, throwing stars, num-chucks, sound effects of mis-striking, and combinations thereof.

10. The method of claim 1 wherein the simulated physical combat fighting sounds further comprises verbal type sounds comprising: yelling, screaming, and taunting phrases in different languages.

11. A method of simulating a realistic choreograph physical combat fighting sequence comprising:

providing a portable handheld toy, wherein providing a portable handheld toy comprises:

providing a body member having a hollow interior section, a bottom section of the body member angled away from the user when the body member is held in the palm of the user;

providing a speaker coupled to the bottom section angled away form the user;

providing a plurality of buttons coupled to the body member; and providing an audio circuit coupled to the plurality of buttons and housed in the hollow interior of the body member for recording and playing simulated physical combat fighting sounds, wherein pressing different buttons plays different prerecorded simulated physical combat fighting sound;

choreographing a physical combat fight sequence by the user of the handheld toy; and pressing a first button of the plurality of buttons to play a first prerecorded simulated physical combat fighting sound simultaneously as said user performs a first physical combat fighting move so as to create an effect that said first physical combat fighting move created said first physical combat fighting sound;

wherein the simulated physical combat fighting sounds comprises: kicking, punching, karate-type chopping, karate-type slashing, slapping, swooshing type sound effects of mis-strikes, and combinations thereof.

12. The method of claim 11 further comprising pressing a second button of the plurality of buttons to play a second prerecorded simulated physical combat fighting sound simultaneously as said user performs a second different physical combat fighting move so as to create an effect that said second physical combat fighting move created said second physical combat fighting sound.

13. The method of claim 11 wherein providing an audio circuit comprises:

providing a sound recording and storage device for recording and storing the simulated physical combat fighting sounds;

providing a first switching device coupled to the sound recording and storage device and the plurality of switches for selecting one of the simulated physical combat fighting sounds;

providing a second switching device coupled to the sound recording and storage device for recording different physical combat fighting sounds on to the sound recording and storage device;

providing a speaker coupled to the first switching device and the sound recording and storage device;

providing a microphone coupled to the first switching device and the sound recording and storage device; and providing a power supply.

14. The method of claim 11 wherein the body member is AL@ shaped and the speaker is coupled to a front edge of a bottom leg section of the AL@ shaped body section.

15. The method of claim 11 wherein the body member further has a handle coupled to the second side of the body member, the handle having a plurality of ridges, each ridge of the handle corresponding to the ridges on the second side of the body member and the speaker is coupled to a front section of the handle.

16. The method of claim 11 wherein the simulated physical combat fighting sounds further comprises verbal type sounds comprising: yelling, screaming, and taunting phrases in different languages.

17. The method of claim 12 wherein providing the body section further comprises providing a first side which is rounded to allow the first side to fit comfortably in the palm of the user and a second side having a plurality of ridges, the ridges forming finger grips to allow a hand of the user to hold the handheld toy, the body member having a movable cover to replace components of the audio circuit.

18. The method of claim 17 further comprising:

providing the body member having a top area angled towards the user; and coupling the buttons to the top area of the body member, the angled top area allowing the user to more easily press the button when holding the handheld toy.

* * * * *